US011174093B2

(12) United States Patent
Lin

(10) Patent No.: US 11,174,093 B2
(45) Date of Patent: Nov. 16, 2021

(54) REUSABLE STRAW STORAGE DEVICE

(71) Applicant: Ta-Yu Lin, New Taipei (TW)

(72) Inventor: Ta-Yu Lin, New Taipei (TW)

( * ) Notice: Subject to any disclaimer, the term of this patent is extended or adjusted under 35 U.S.C. 154(b) by 0 days.

(21) Appl. No.: 16/847,475

(22) Filed: Apr. 13, 2020

(65) Prior Publication Data

US 2021/0316937 A1 Oct. 14, 2021

(51) Int. Cl.
*B65D 85/14* (2006.01)
*B65D 25/10* (2006.01)

(52) U.S. Cl.
CPC ..... *B65D 85/14* (2013.01); *B65D 25/107* (2013.01)

(58) Field of Classification Search
CPC ..... B65D 25/10; B65D 25/107; B65D 85/14; B62J 11/00
See application file for complete search history.

(56) References Cited

U.S. PATENT DOCUMENTS 4,095,710 A * 6/1978 Tomiati ..... A47G 21/18 220/708
4,095,812 A * 6/1978 Rowe ..... B62J 11/00 224/414
5,067,629 A * 11/1991 Schwartz ..... A47G 21/184 221/70
5,503,296 A * 4/1996 DiBaggio ..... B65D 77/283 220/708
7,845,513 B2 * 12/2010 White ..... A47G 21/182 220/705
8,684,178 B1 * 4/2014 Solomon ..... B65H 75/364 206/408

* cited by examiner

*Primary Examiner* — Bryon P Gehman

(57) ABSTRACT

A reusable straw storage device includes a storage unit, and a winding unit mounted in the storage unit and rotatable to roll up a reusable straw, enabling the reusable straw to be rolled up in the storage unit.

9 Claims, 15 Drawing Sheets

REUSABLE STRAW STORAGE DEVICE

BACKGROUND OF THE INVENTION

1. Field of the Invention

The present invention relates to reusable straw storage device and more particularly, to such a reusable straw storage device, which is convenient to use and practical for storing and carrying a used or cleaned reusable straw.

2. Description of the Related Art

Plastic straws are disposable products, which have a considerable impact on the environment. Therefore, many countries start to limit the use of plastic straws. The existing method of replacing plastic straws is to use reusable straws made of flexible materials, so that reusable straws can be cleaned for repeated use. However, how to conveniently use, store and carry reusable straws or cleaned reusable straws is a subject of research and development for the relevant industry.

SUMMARY OF THE INVENTION

The present invention has been accomplished under the circumstances in view. It is therefore the main object of the present invention to provide a reusable straw storage device, which is convenient to use and practical for storing and carrying a used or cleaned reusable straw.

To achieve this and other objects of the present invention, a reusable straw storage device comprises a storage unit and a winding unit. The storage unit comprises an outer casing and a bushing. The outer casing comprises an accommodating space defined therein and at least one placement slot in communication between the accommodating space and the space outside the storage unit. The bushing is mounted in the accommodating space of the outer casing, comprising an upright dust wall and at least one opening cut through the upright dust wall. The winding unit comprises a covering device and a positioning member. The covering device is capped on the outer casing over the accommodating space. The positioning member is connected to the covering device, comprising a plurality of clamping plates suspending in the accommodating space. The bushing is rotatable in the outer casing between an open position where the at least one opening is kept in alignment with the at least one placement slot, and a close position where the at least one opening is blocked by the outer casing. When the at least one opening is kept in alignment with the at least one placement slot, one end of a reusable straw can be insertable through the at least one placement slot and the at least one opening into a gap between the clamping plates of the positioning member, letting the inserted reusable straw be rolled up by the positioning member upon rotation of the covering device relative to the storage unit and then received inside the storage unit.

DETAILED DESCRIPTION OF THE PREFERRED EMBODIMENT

Figure 1:
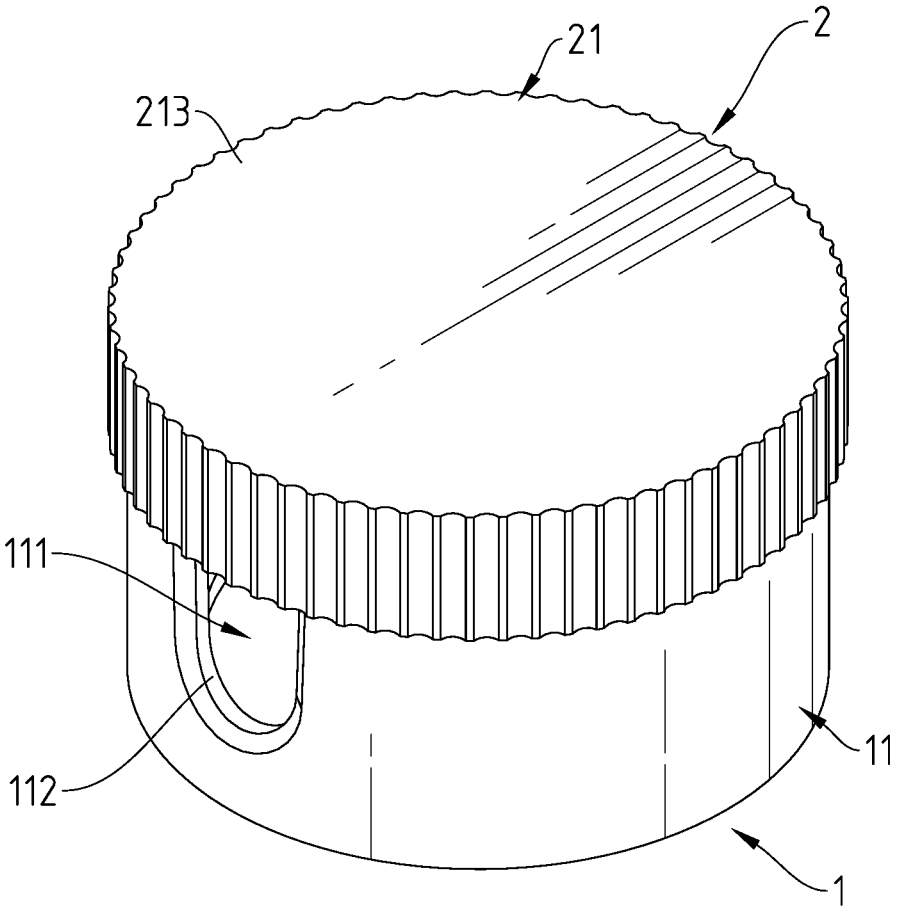
FIG. 1 is an oblique top elevational view of a reusable straw storage device in accordance with a first embodiment of the present invention.
Figure 2:
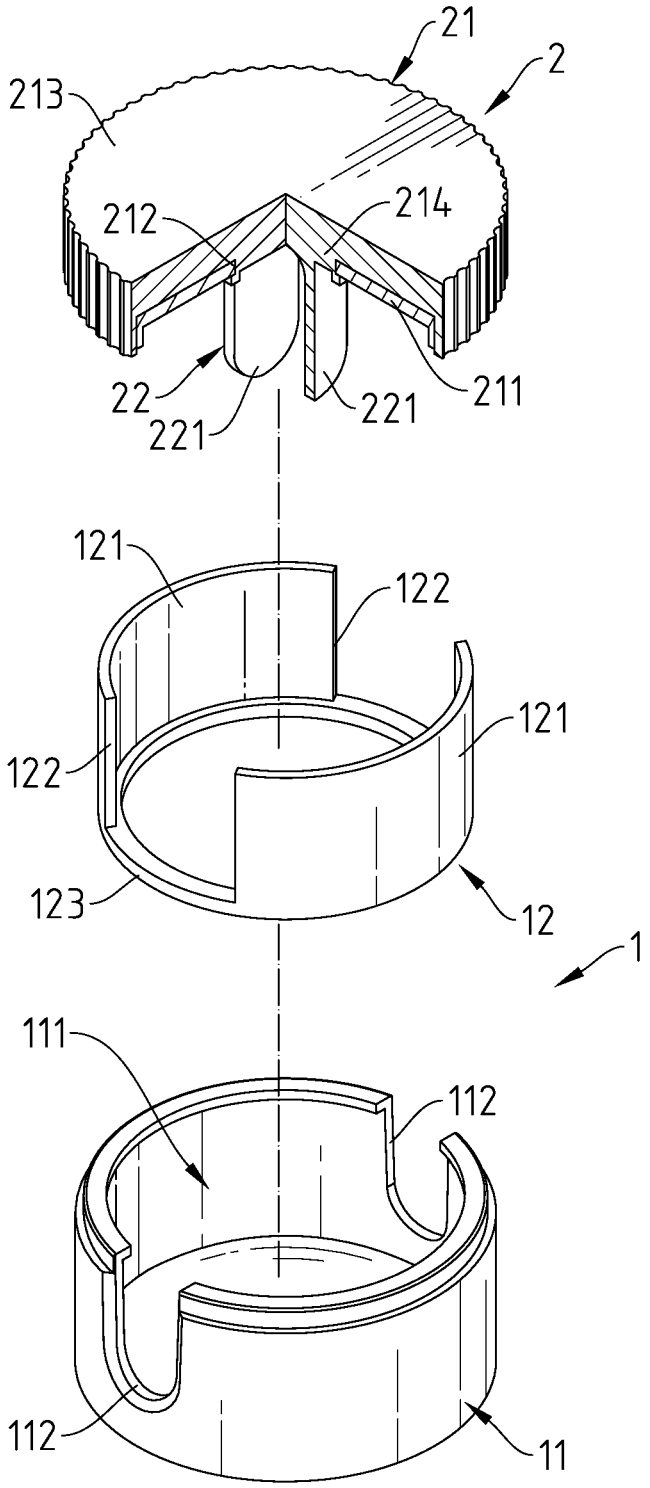
FIG. 2 is an exploded view of the reusable straw storage device in accordance with the first embodiment of the present invention.
Figure 3:
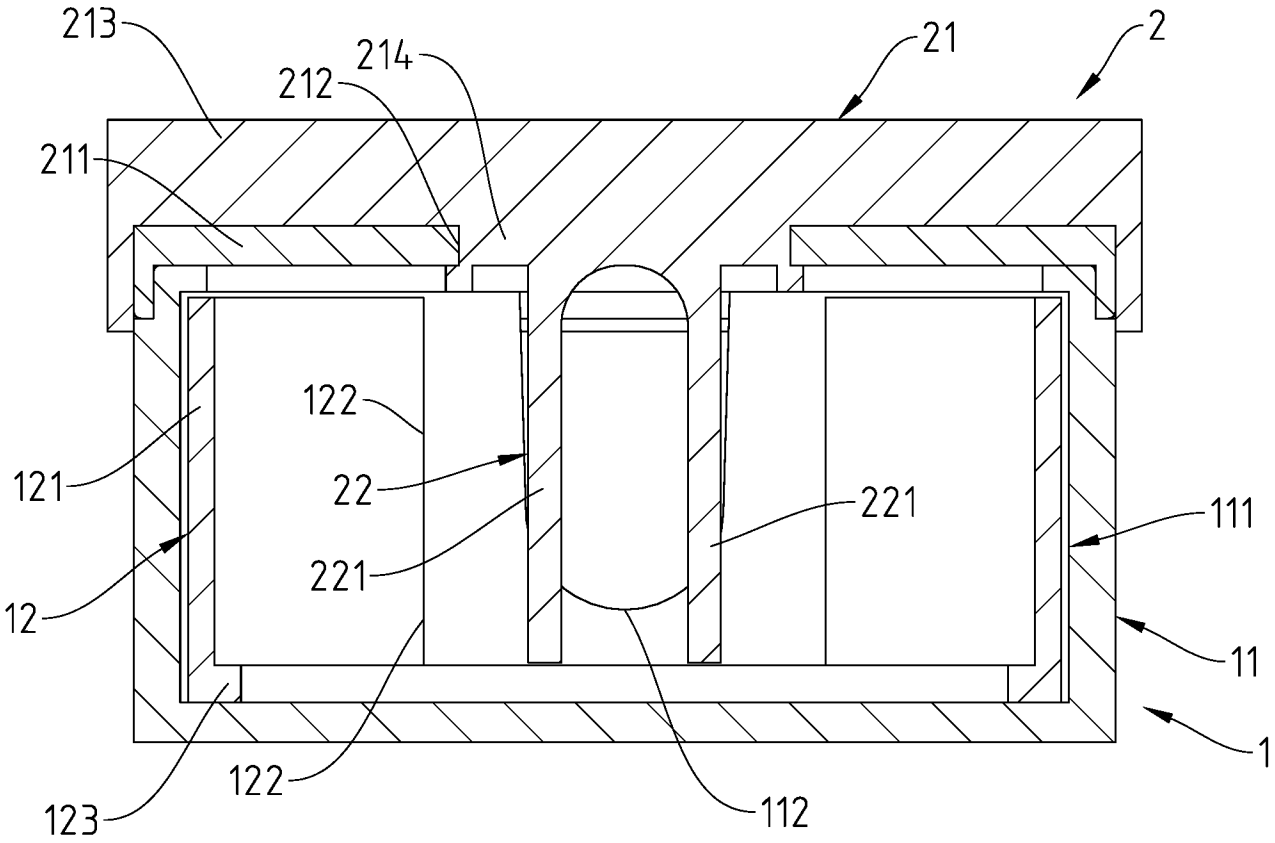
FIG. 3 is a sectional view of the reusable straw storage device in accordance with the first embodiment of the present invention.

Referring to FIGS. 1-3, a reusable straw storage device in accordance with a first embodiment of the present invention is shown. The reusable straw storage device comprises a storage unit 1 and a winding unit 2.

The storage unit 1 comprises an outer casing 11 and a bushing 12. The outer casing 11 is provided with an accommodating space 111, and two opposite placement slots 112 in communication with the accommodating space 111. The bushing 12 is installed in the accommodating space 111 of the outer casing 11, comprising a ring-shaped base 123 disposed in proximity to the bottom of the accommodating space 111 of the outer casing 11, a dust wall 121 perpendicularly upwardly extended from the periphery of the ring-shaped base 123 and surrounded by the inner wall of the accommodating space 111 of the outer casing 11 and two opposite openings 122 located on the dust wall 121 corresponding to the placement slots 112. The width of the placement slots 112 is smaller than the width of the openings 122 of the bushing 12.

The winding unit 2 comprises a covering device 21 and a positioning member 22. The covering device 21 is composed of a pivot cover 211 and a rotating cover 213. The pivot cover 211 is attached to the upper side of the accommodating space 111 of the outer casing 11, having a pivot hole 212 at the center thereof. The rotating cover 213 has a pivot 214 downwardly extended from the center of the bottom wall thereof. The positioning member 22 comprises two clamping plates 221 that are formed integral with and downwardly extended from the pivot 214 of the rotating cover 213. The rotating cover 213 is covered on the pivot cover 211 with the pivot 214 pivotally coupled to the pivot hole 212 to suspend the clamping plates 221 in the accommodating space 111.

Figure 4:
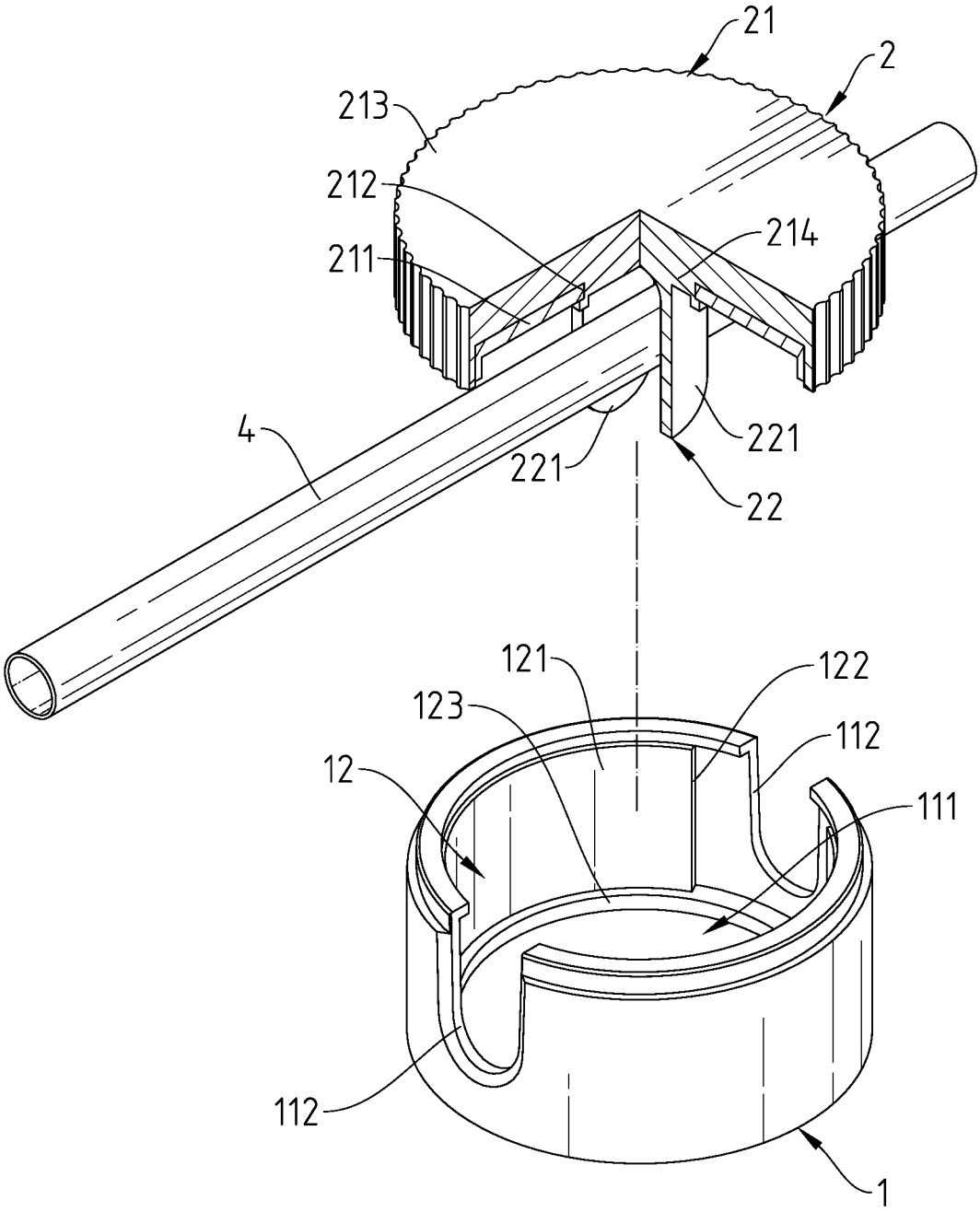
FIG. 4 is a schematic applied view of the reusable straw storage device in accordance with the first embodiment of the present invention, showing a reusable straw inserted into a gap between the clamping plates.
Figure 5:
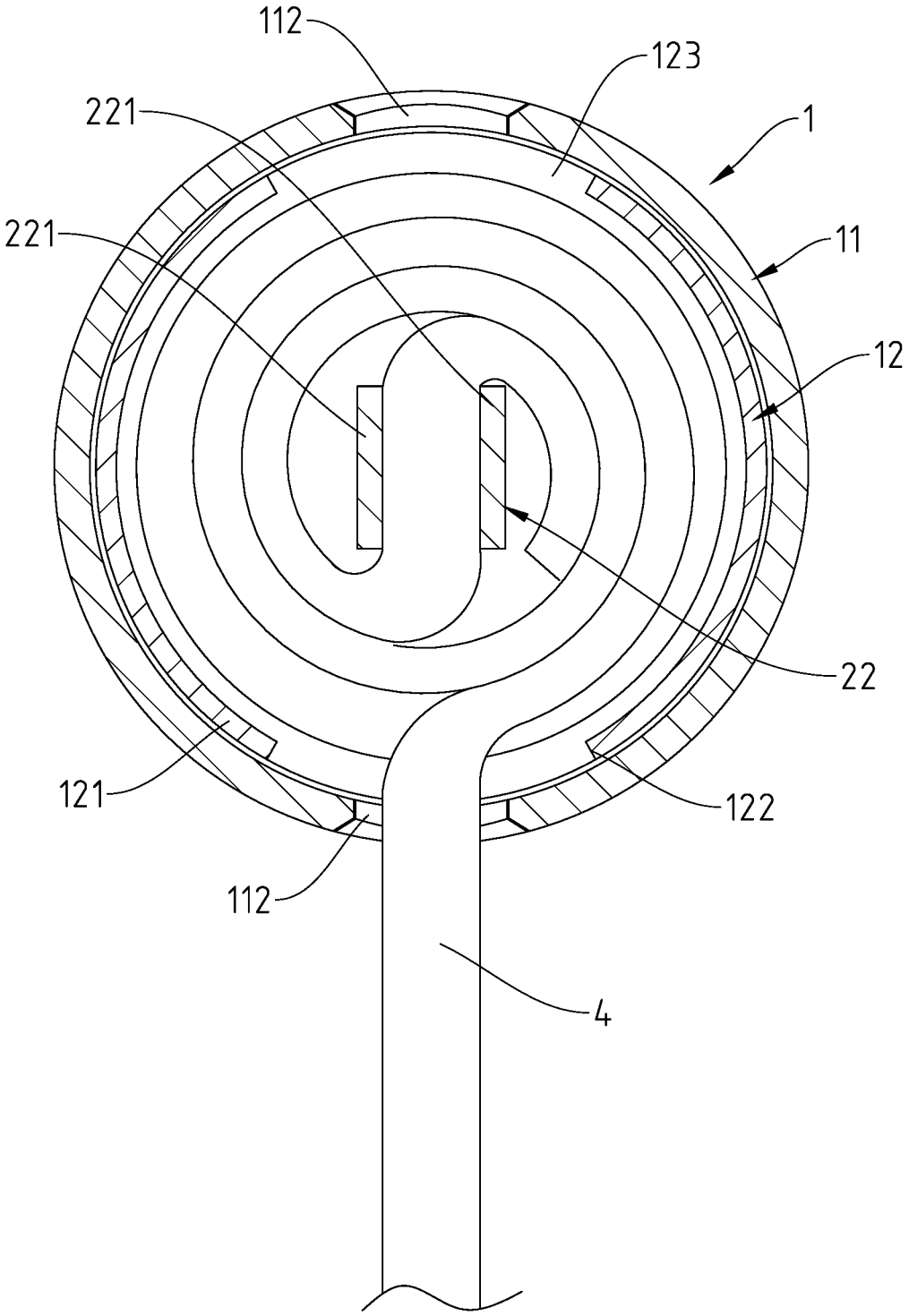
FIG. 5 is a schematic top view of the reusable straw storage device in accordance with the first embodiment of the present invention, showing the reusable straw partially rolled up.
Figure 6:
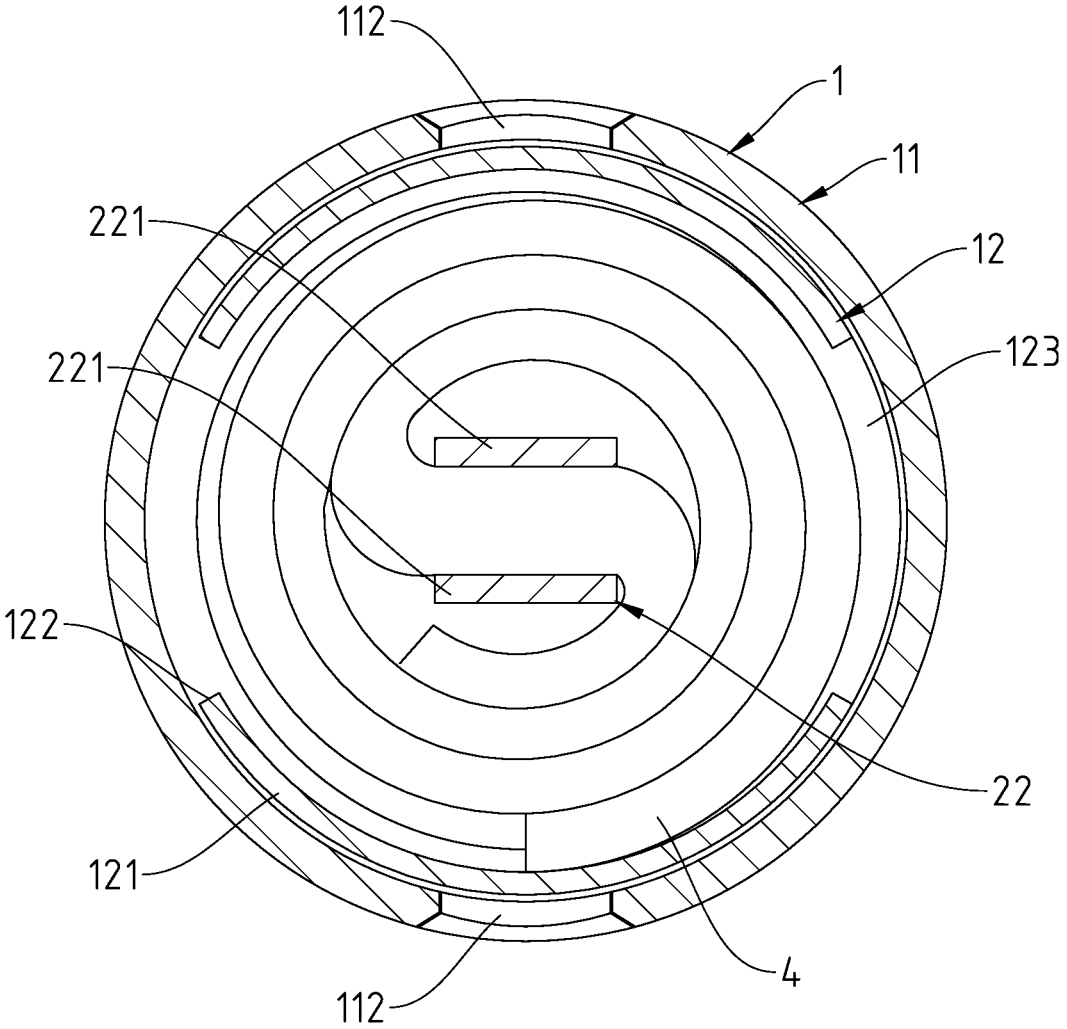
FIG. 6 corresponds to FIG. 5, showing the reusable straw completely rolled up and received inside the storage unit.

Referring to FIGS. 4-6, when the reusable straw storage device is in use, enable the placement slots 112 of the storage unit 1 to be respectively kept in line with the openings 122 of the bushing 12. If the dust wall 121 of the bushing 12 blocks the placement slots 112 of the storage unit 1, push the dust wall 121 of the bushing 12 relative to the storage unit 1 to move the placement slots 112 of the storage unit 1 into alignment with the openings 122 of the bushing 12. Then, insert the reusable straw 4 from one placement slot 112 and the adjacent opening 122 into the accommodating space 111, enabling the tip of the reusable straw 4 to enter the space between the two clamping plates 221. At this time, operate the rotating cover 213 to rotate the clamping plates 221 relative to the storage unit 1, causing the clamping plates 221 to roll up the reusable straw 4 in the accommodating space 111 of the storage unit 1. After the reusable straw 4 is completely received in the storage unit 1, the elastic restoring energy of the reusable straw 4 force the tip thereof into contact with the dust wall 121 of the bushing 12. When continuously rotate the winding unit 2 relative to the storage unit 1 for a certain distance, the dust wall 121 of the bushing 12 will be moved into a closed position to block the placement slots 112, keeping the storage unit 1 in an enclosed state to prevent the reusable straw 4 from being polluted by the outside world, or the residual liquid in the reusable straw 4 from flowing out of the storage unit 1.

Figure 7:
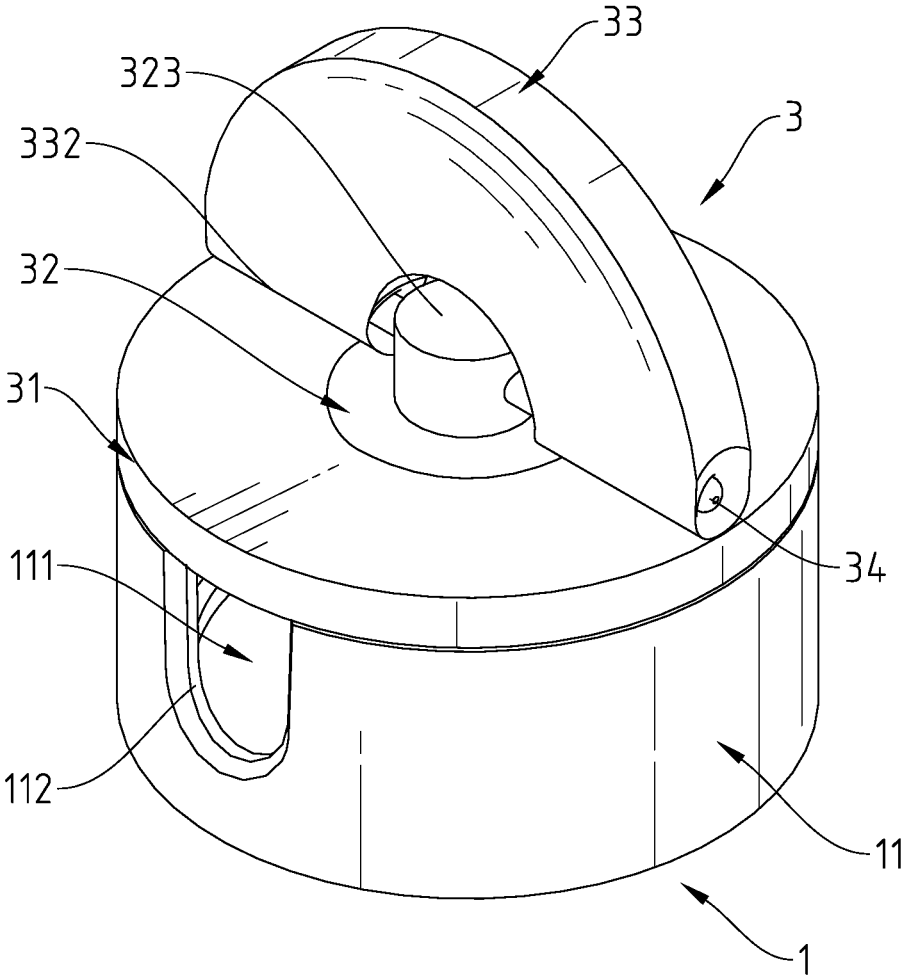
FIG. 7 is an oblique top elevational view of a reusable straw storage device in accordance with a second embodiment of the present invention.
Figure 8:
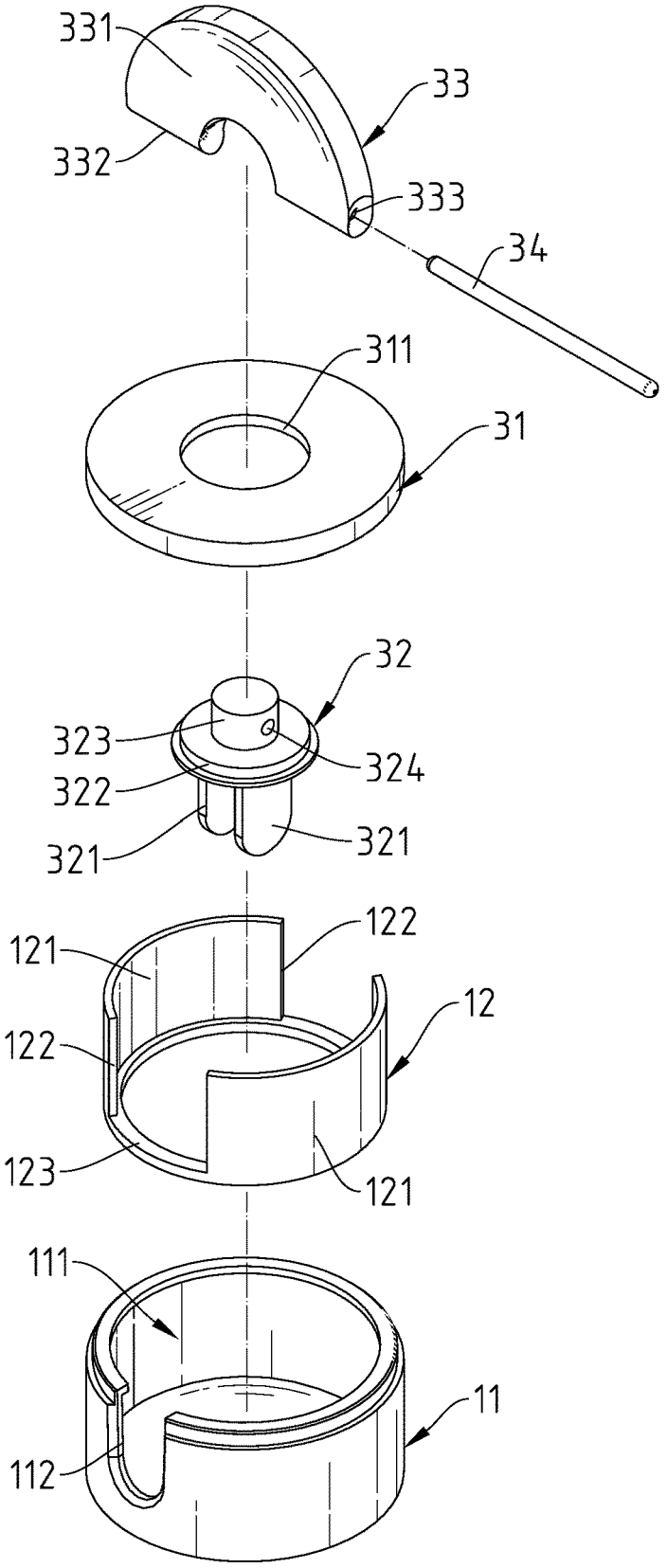
FIG. 8 is an exploded view of the reusable straw storage device in accordance with the second embodiment of the present invention.
Figure 9:
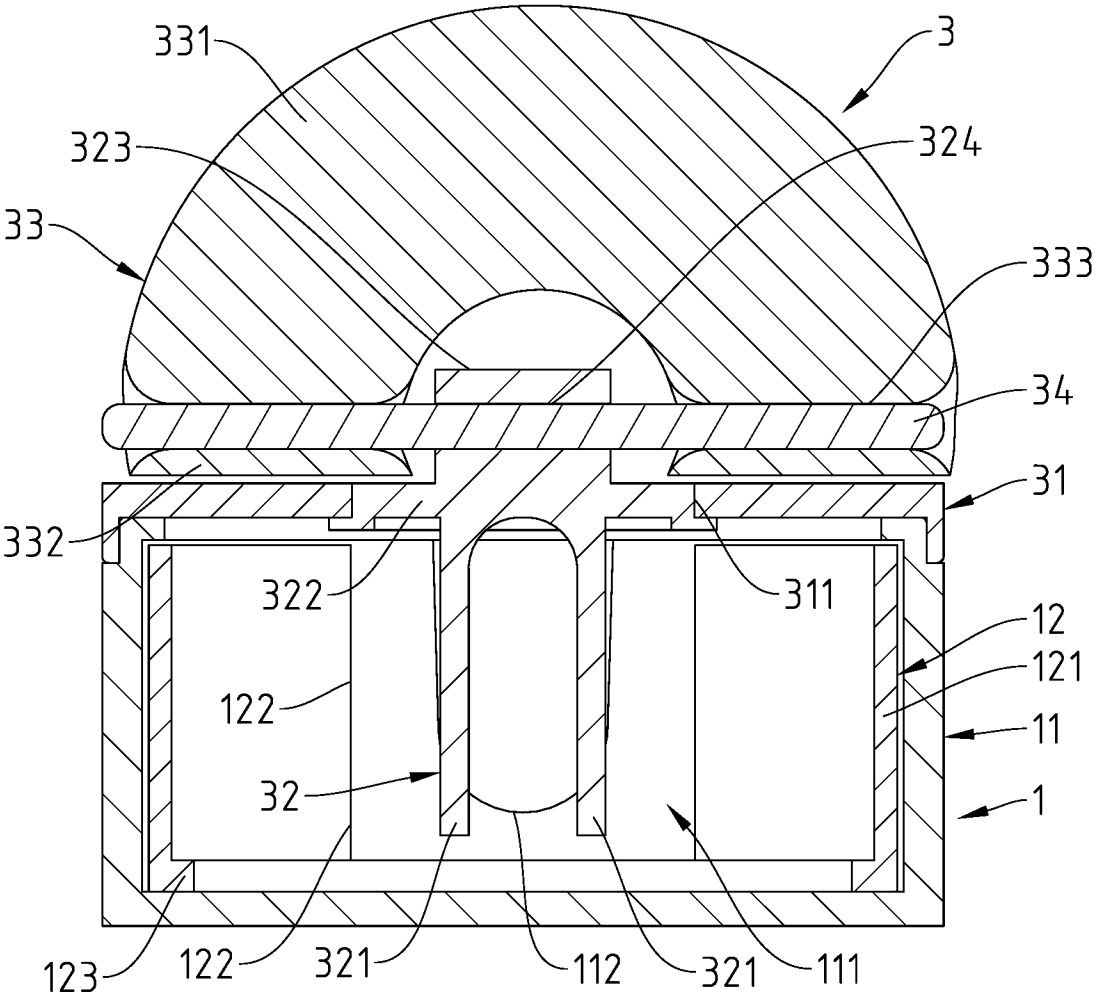
FIG. 9 is a sectional view of the reusable straw storage device in accordance with the second embodiment of the present invention.

Referring to FIGS. 7-9, a reusable straw storage device in accordance with a second embodiment of the present invention is shown. This second embodiment is substantially similar to the aforesaid first embodiment with the exception of the winding unit. According to this second embodiment, the winding unit, referenced by 3, the winding unit 3 further comprises an operating plate 33 and a pin 24. Further, the covering device, referenced by 31, is provided with a pivot hole 311. The positioning member, referenced by 32, has a pivot 322 pivotally coupled to the pivot hole 311. The clamping plates, referenced by 321, are downwardly extended from the bottom end of the pivot 322. The pivot 322 has a top driven component 323. The operating plate 33 comprises a grip portion 331, two connection portions 332 respectively extended from two opposite ends of the grip portion 331, and a positioning hole 333 located on each connection portion 332. The top driven component 323 of the positioning member 32 is provided with a transverse through hole 324. The two connection portions 332 are disposed at two opposite sides relative to the top driven component 323. The pin 34 is mounted in the transverse through hole 324 and the positioning holes 333 to pivotally connect the operating plate 33 to the positioning member, referenced by 32 above the covering device 31, allowing the operating plate 33 to be biased between a horizontal position where the operating plate 33 is closely disposed in contact with the top surface of the covering device 31 and a vertical position where the operating plate 33 is kept perpendicular to the covering device 31. When the operating plate 33 is kept perpendicular to the covering device 31, the user can hold the grip portion 331 with the fingers and then rotate the operating plate 33, causing rotation of the clamping plates 321.

Figure 10:
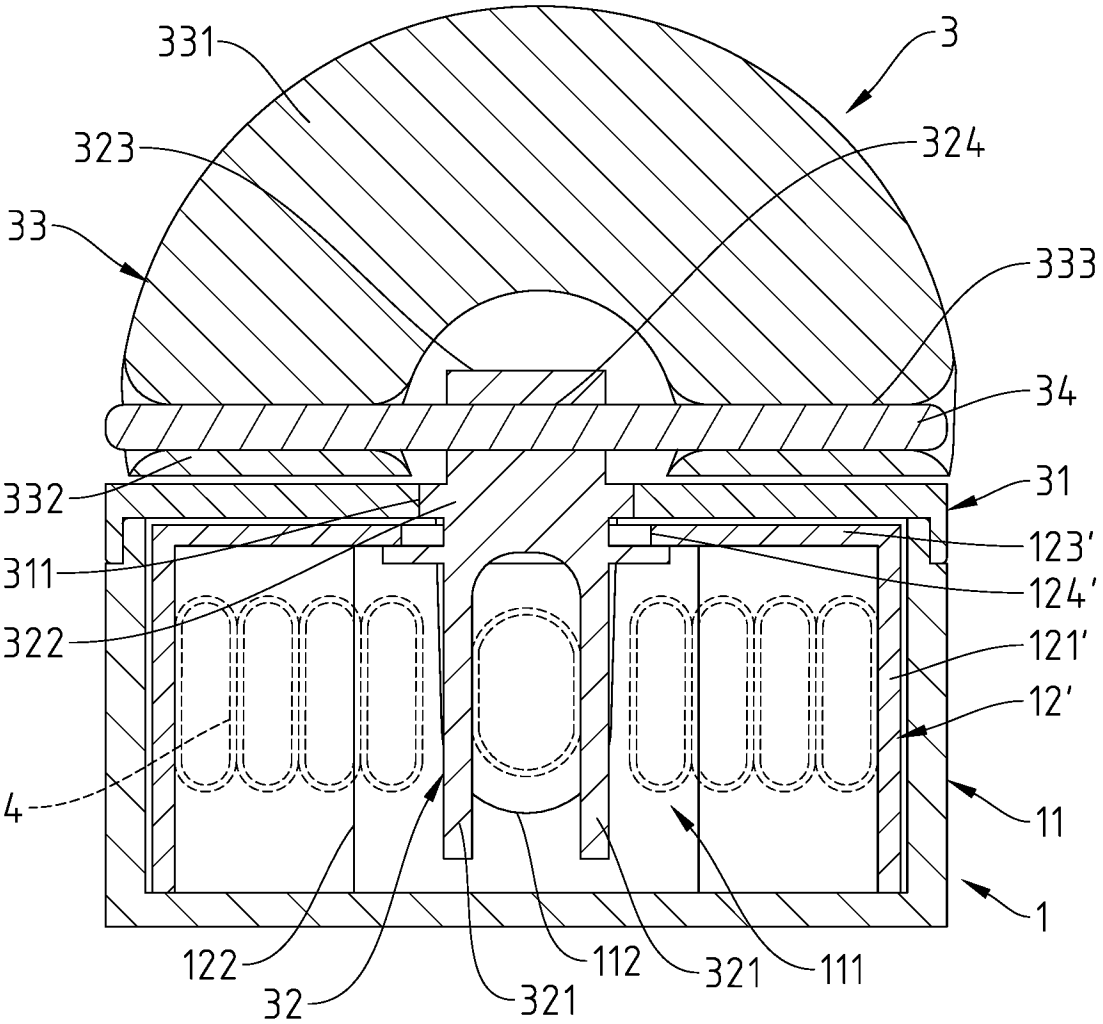
FIG. 10 is a sectional view of a reusable straw storage device in accordance with a third embodiment of the present invention.
Figure 11:
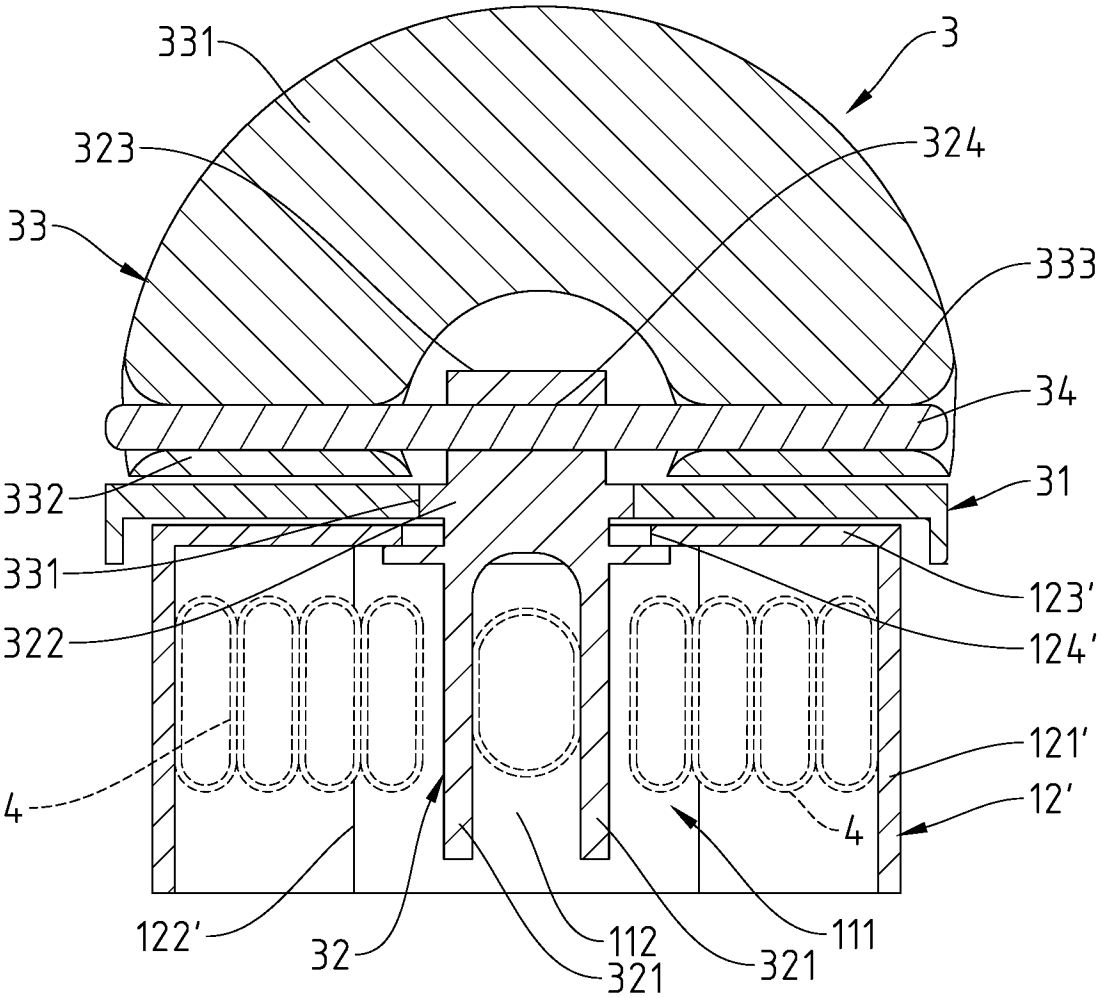
FIG. 11 corresponds to FIG. 10, showing a reusable straw rolled up and received in the storage unit.

Referring to FIGS. 10 and 11, a reusable straw storage device in accordance with a third embodiment of the present invention is shown. This third embodiment is substantially similar to the aforesaid second embodiment with the exception as outlined hereinafter. The base 123' of the bushing 12' is provided with a pivot hole 124'. Further, the base 123' is kept in the outer casing 11 far from the bottom wall of the accommodating space 111. The clamping plates 321 of the winding unit 3 are inserted through the pivot hole 124' into the accommodating space 111. After the reusable straw 4 is rolled up and received inside the storage unit 1, the elastic restoring energy causes the rolled-up reusable straw 4 to firmly abut against the inside wall of the bushing 12'. If the covering device 31 is opened at this time, the reusable straw 4 is still retained in the bushing 12'.

Figure 12:
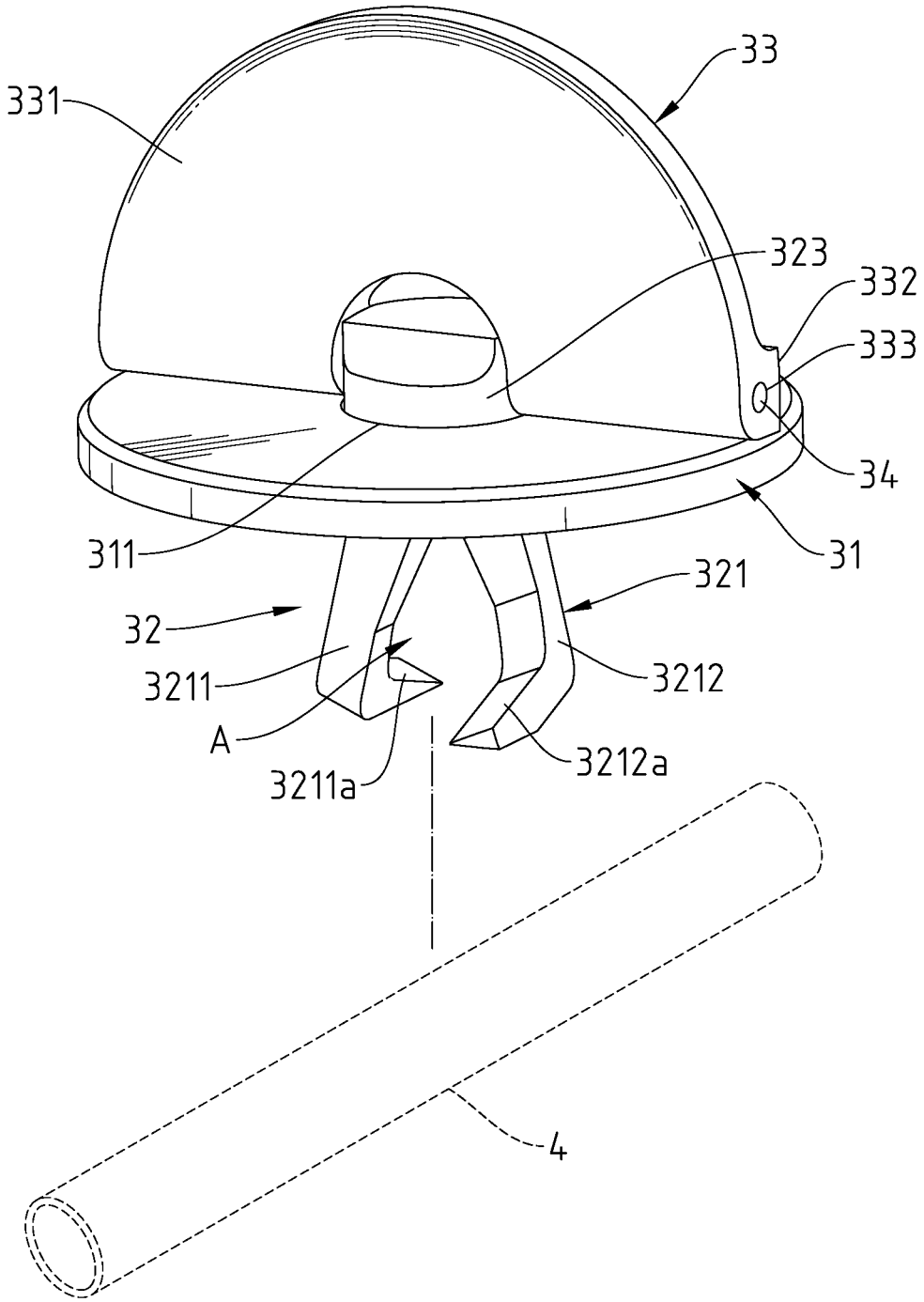
FIG. 12 is an elevational view of a reusable straw storage device in accordance with a fourth embodiment of the present invention.
Figure 13:
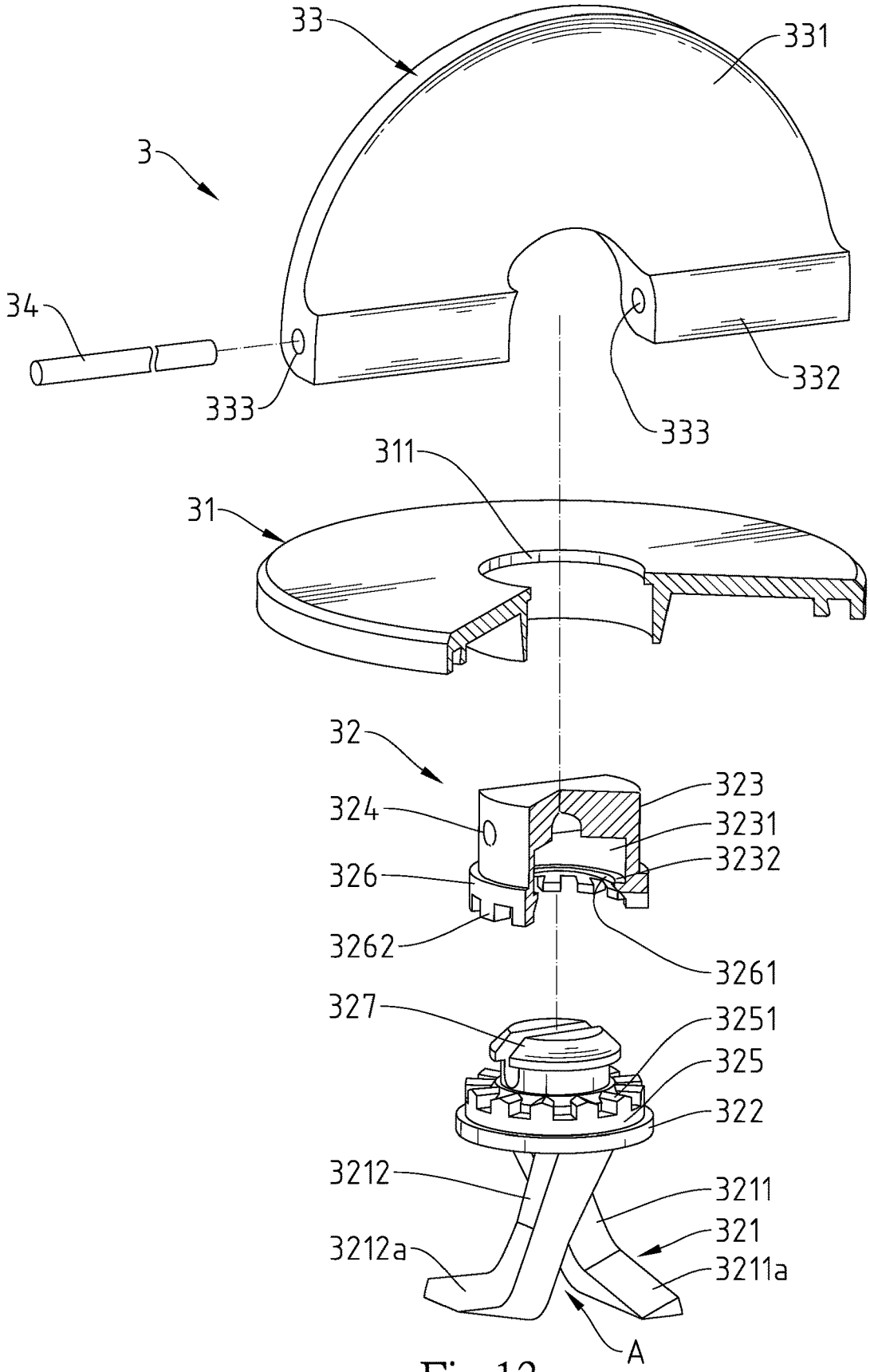
FIG. 13 is an exploded view, partially in sectional elevation, of the reusable straw storage device in accordance with the fourth embodiment of the present invention.

Referring to FIGS. 12 and 13, for better storage and access of the reusable straw 4, a fourth embodiment of the present invention provides an alternative form of the positioning member 32. The differences between the positioning member 32 of the aforesaid second embodiment and the positioning member 32 of the present fourth embodiment are outlined hereinafter. As illustrated, the positioning member 32 comprises two clamping plates 321, a pivot 322, a top driven component 323, a first crown gear 325 and a second crown gear 326. The clamping plates 321 extend from the bottom edge of the pivot 322. The first crown gear 325 is located on the top edge of the pivot 322. The first crown gear 325 has a clamping element 327 located at the center thereof, and a first series of teeth 3251 disposed around the bottom side of the clamping element 327. The second crown gear 326 is set on the bottom surface of the top driven component 232. The top driven component 323 has an accommodation chamber 3231 located at the center of the bottom surface thereof. The second crown gear 326 has a through hole 3261. The second series of teeth 3262 is disposed around the through hole 3261. The through hole 3261 communicates with the accommodation chamber 3231. A locating element 3232 suspends in the accommodation chamber 3231. The first series of teeth 3251 is disposed corresponding to the second series of teeth 3262. The locating element 3232 is pivotally connected to the clamping element 327.

The covering device 31 is provided with a pivot hole 311. The pivot 322 is pivoted to the pivot hole 311. The winding unit 3 further comprises an operating plate 33 and a pin 34. The operating plate 33 comprises a grip portion 331, two connection portions 332 respectively extended from two opposite ends of the grip portion 331, and a positioning hole 333 located on each connection portion 332.

The top driven component 323 of the positioning member 32 is provided with a transverse through hole 324. The two connection portions 332 are disposed at two opposite sides relative to the top driven component 323. The pin 34 is mounted in the transverse through hole 324 and the positioning holes 333.

The clamping plates 321 each comprise a clamping portion 3211,3212 connected to the pivot 322, and a curved tip 3211*a*, 3212*b* extended from the clamping portion 3211, 3212 remote from the pivot 322. The curved tips 3211*a*, 3212*b* of the two clamping portions 3211,3212 are set in a reversed and staggered manner, so that a clamping space A is formed between the curved tips 3211*a*,3212*b* of the two clamping portions 3211,3212.

Figure 14:
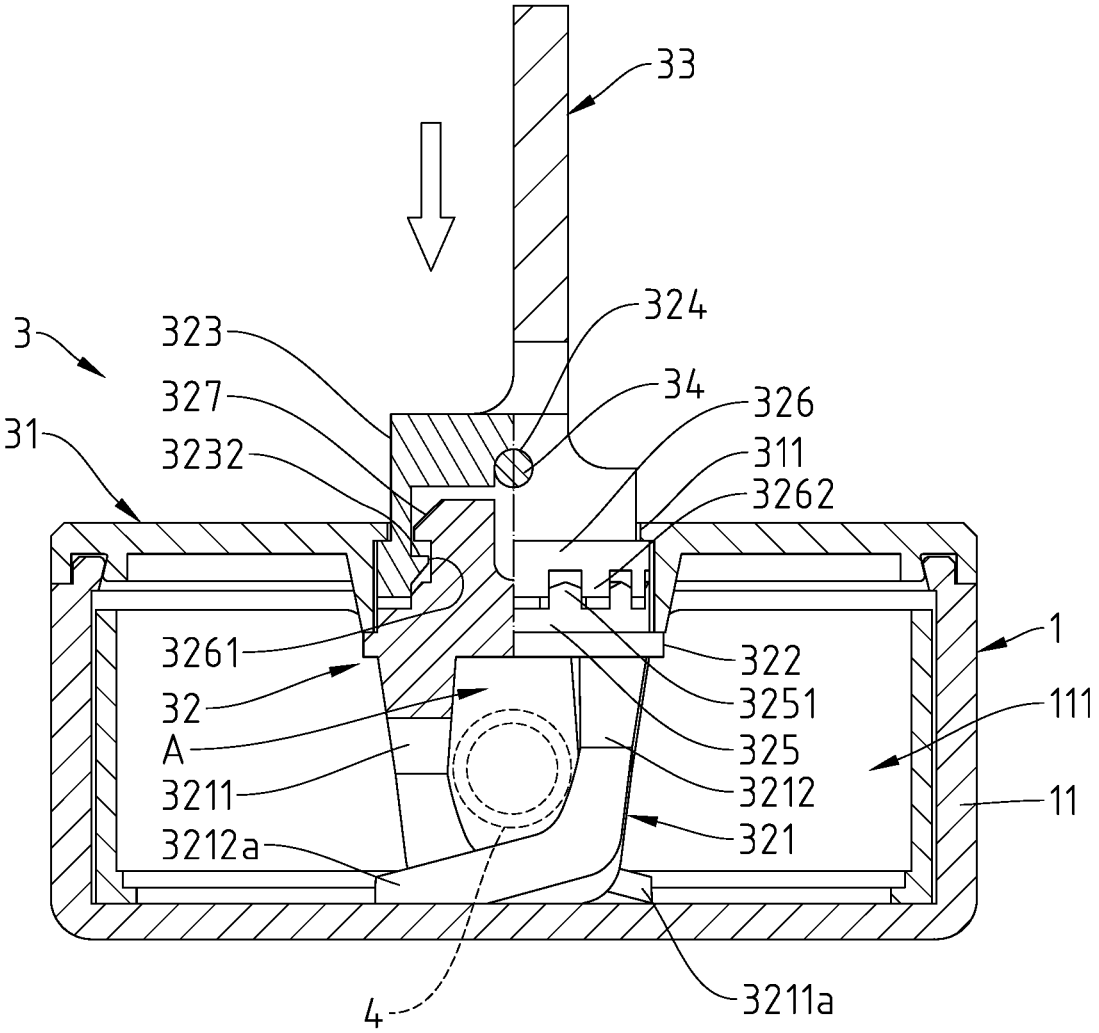
FIG. 14 is a schematic sectional view of the fourth embodiment of the present invention, illustrating the storage unit received in the storage unit.

Referring to FIG. 14, when receiving a reusable straw 4, place the reusable straw 4 in the clamping space A, enabling the reusable straw 4 to be held between the two clamping portions 3211,3212 by the curved tip 3211*a* and the curved tip 3212*a*. Then, cover the covering device 31 on the top side of the accommodating space 111 of the outer casing 11, so that the clamping plates 321 of the positioning member 32 are disposed in the accommodation space 11. Thereafter, hold the grip portion 331 to lift the operating plate 33 from the covering device 31, and then rotate the operating plate 33, causing rotation of the top driven component 323 and the second crown gear 326 with the operating plate 33. Subject the engagement between the first series of teeth 3251 and the second series of teeth 3262, the rotary motion of the second crown gear 326 drives the first crown gear 325 and the clamping plate 321 to rotate, causing the reusable straw 4 to be scrolled by the clamping plates 321 and received in the accommodation space 111 of the storage unit 1.

Figure 15:
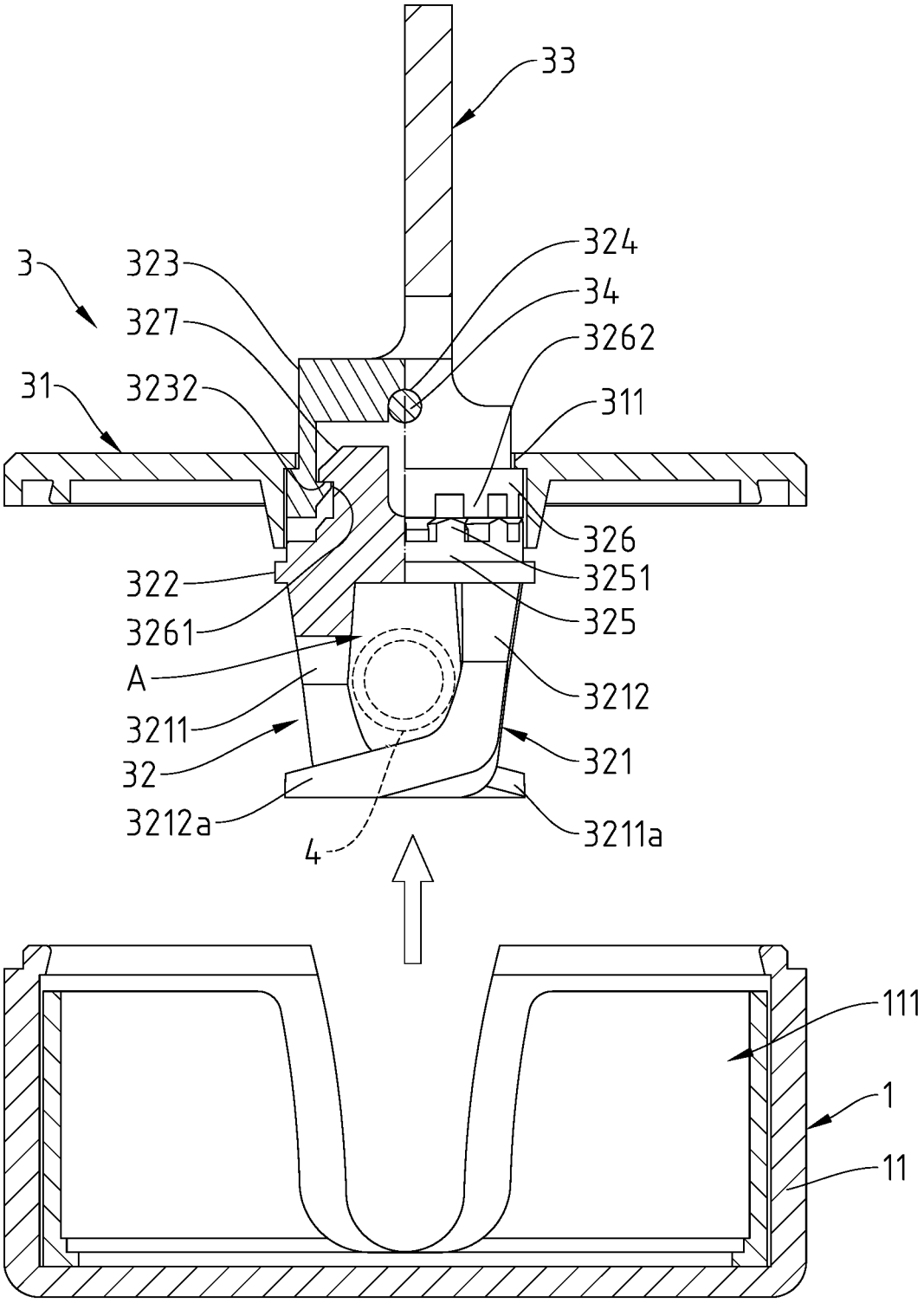
FIG. 15 corresponds to FIG. 14, showing the winding unit taken out of the storage unit.

Referring to FIG. 15, when using the reusable straw 4, hold the grip portion 331 to lift the operating plate 33, thereby disengaging the second series of teeth 3262 of the second crown gear 326 from the first series of teeth 3251 of the first crown gear 325. Thereafter, remove the winding unit 3 from the storage unit 1. Since the locating element 3232 is pivotally connected to the clamping element 327 and the second series of teeth 3262 of the second crown gear 326 is disengaged from the first series of teeth 3251 of the first crown gear 325, when the reusable straw 4 is elastically reset from the scrolled state to the straight state, the centrifugal force produced by the reusable straw 4 forces the first crown gear 325 to rotate relative to the second crown gear 326. By absorbing the centrifugal force, the positioning of the reusable straw 4 is more stable after resetting, thereby preventing the reusable straw 4 from falling out of the clamping space A.

What is claimed is:

1. A reusable straw storage device, comprising:

a storage unit comprising an outer casing and a bushing, said outer casing comprising an accommodating space defined therein and at least one placement slot in communication between said accommodating space and space outside said storage unit, said bushing being mounted in said accommodating space of said outer casing, said bushing comprising an upright dust wall and at least one opening through said upright dust wall; and a winding unit comprising a covering device and a positioning member, said covering device being capped on said outer casing over said accommodating space, said positioning member being connected to said covering device and comprising a plurality of clamping plates suspended in said accommodating space;

wherein said bushing is rotatable in said outer casing between an open position where said at least one opening is kept in alignment with said at least one placement slot, and a closed position where said at least one opening is blocked by said outer casing;

wherein when said at least one opening is kept in alignment with said at least one placement slot, one end of a reusable straw is insertable through said at least one placement slot and said at least one opening into a gap between said clamping plates of said positioning member for letting the reusable straw to be rolled up by said positioning member upon rotation of said covering device relative to said storage unit and then received inside said storage unit.

2. The reusable straw storage device as claimed in claim 1, wherein a width of each said placement slot of said outer casing of said storage unit is smaller than a width of each said opening of said bushing.

3. The reusable straw storage device as claimed in claim 1, wherein said covering device of said winding unit comprises a pivot cover and a rotating cover, said pivot cover being capped on said outer casing over said accommodating space, said pivot cover comprising a pivot hole, said rotating cover comprising a pivot downwardly extending from a bottom side of the rotating cover and pivotally coupled to said pivot hole said clamping plates of said positioning member extending from a bottom end of said pivot so that said clamping plates are rotatable with said rotating cover relative to said outer casing.

4. The reusable straw storage device as claimed in claim 1, wherein said covering device of said winding unit comprises a pivot hole, said positioning member comprises a pivot pivotally coupled to said pivot hole, said pivot comprising a top driven component rotatable by an external force and said clamping plates downwardly extend from a bottom end of said pivot for rotation with said pivot.

5. The reusable straw storage device as claimed in claim 4, wherein said top driven component of said positioning member comprises a transverse through hole said winding unit further comprises an operating plate and a pin, said operating plate comprising a grip portion, two connection portions each respectively disposed on opposite ends of said grip portion and respectively disposed on opposite sides relative to said top driven component of said pivot, a respective positioning hole located in each said connection portion, said pin being mounted in said transverse through hole and said positioning holes to pivotally connect said operating plate to said positioning member above said covering device, allowing said operating plate to be positioned between a horizontal position where said operating plate is disposed in contact with a top surface of said covering device and a vertical position where said operating plate is perpendicular to said covering device.

6. The reusable straw storage device as claimed in claim 1, wherein said bushing further comprises a base and a pivot hole located on said base, said base being integral with a bottom side of said upright dust wall and disposed in said outer casing away from a bottom wall of said accommodating space; and said clamping plates are inserted through said pivot hole of said base of said bushing into said accommodating space when said covering device is covered on said outer casing.

7. The reusable straw storage device as claimed in claim 1, wherein said positioning member comprises two said clamping plates, a pivot, a top driven component, a first crown gear, and a second crown gear, said clamping plates extending from a bottom edge of said pivot, said first crown gear being located on an opposing top edge of said pivot, said first crown gear comprising a clamping element located at a center thereof and a first series of teeth disposed around a bottom side of said clamping element, said second crown gear being set on a bottom surface of said top driven component, said top driven component comprising an accommodation chamber located at a center of the bottom surface of said top driven component, and a locating element suspended in said accommodation chamber, said second crown gear having a through hole, a second series of teeth being disposed around said through hole, said through hole communicating with said accommodation chamber, said first series of teeth being disposed corresponding to said second series of teeth, said locating element being pivotally connected to said clamping element, said covering device being provided with a pivot hole, said pivot being pivoted to said pivot hole, said first series of teeth being engaged with said second series of teeth so that rotating said top driven component causes rotation of said clamping plates.

8. The reusable straw storage device as claimed in claim 7, wherein said top driven component is comprises a transverse through hole, said winding unit further comprises an operating plate and a pin, said operating plate comprising a grip portion, two connection portions each respectively disposed on opposite ends of said grip portion, and a respective positioning hole located in each said connection portion, said two connection portions each being respectively disposed at opposite sides of said top driven component, said pin being mounted in said transverse through hole and said positioning holes, said operating plate being liftable from said covering device and operable to rotate said clamping plates relative to said covering device.

9. The reusable straw storage device as claimed in claim 7, wherein said clamping plates each comprise a clamping portion connected to said pivot and a curved tip extended from said clamping portion remote from said pivot, said curved tips of said two clamping portions being set in a reversed and staggered manner, so that a clamping space is formed between said curved tips of said two clamping portions.

* * * * *